US005427554A

United States Patent [19]

Foglia

[11] Patent Number: 5,427,554

[45] Date of Patent: Jun. 27, 1995

[54] RECREATIONAL WATER CRAFT

[76] Inventor: Silvino R. Foglia, 105 Banyan Cir., Jupiter, Fla. 33458

[21] Appl. No.: 74,071

[22] Filed: Jun. 8, 1993

[51] Int. Cl.[6] ..... B63H 16/20

[52] U.S. Cl. ..... 440/26; 114/39.1; 114/61; 114/58; 440/90

[58] Field of Search ..... 440/21, 26, 27, 90; 114/39.1, 61, 58

[56] References Cited

U.S. PATENT DOCUMENTS

| | | | |
|---|---|---|---|
| 523,518 | 7/1894 | Foerste | 114/58 X |
| 2,956,534 | 10/1960 | Archer | 114/61 |
| 2,998,798 | 9/1961 | Love | 440/90 X |

FOREIGN PATENT DOCUMENTS

| | | | |
|---|---|---|---|
| 7315110 | 11/1974 | France | 440/26 |

*Primary Examiner*—Sherman Basinger

[57] ABSTRACT

A recreational water craft of uncomplicated design and construction is provided herein which is adaptive to be manually powered by one or more crew members or readily converted from manual power to sail (or supplement by sail) without loss of stability or increase in complexity of operation. This water craft possesses the attributes of a tri-hull and/or catamaran vessel, wherein the crew is supported and operates such vessel from a centrally located platform or main float which is connected to, and flanked on either side by, an outrigger float or pontoon. Each outrigger float is further provided with a vertical extension or riser to which is mounted an independently operated and manually powered paddle wheel. The paddle wheels, upon mounting to the riser, are positioned in the open wells located to the port and starboard sides of the platform and inboard of each of the outrigger floats. The paddle wheels each have a handle or hand grip on their inboard surface, which can be adjusted relative to the axis of rotation of each of such wheel, to accommodate the crew member's reach and his location on the main float, and thereby modulate the amount of force, and physical exertion, required to rotate the paddle wheel. Insofar as each of the paddle wheels is independently driven, the water craft's directional movement (steering) is determined by the relative amount of thrust created by rotation of either paddle wheel or by the counter-rotation of each such paddle wheel relative to one another.

7 Claims, 3 Drawing Sheets

RECREATIONAL WATER CRAFT

BACKGROUND OF THE INVENTION

1. Field of the Invention

This invention relates to an article of manufacture. More specifically, this invention involves a recreational water craft of unique design and construction. The water craft described herein is manually powered by one or more pair of paddle wheels, each member of said pair being independently mounted and driven; and, can be converted to, sail power and thereby take on both the appearance and sailing characteristic of a mini-catamaran.

2. Description of the Prior Art

The designer of water craft for commercial, sport and recreational environments are generally driven by similar considerations and yet approach their respective challenges very differently. More specifically, the commercial vessel (e.g. cargo or tanker) has as its dominant design feature the ability to transport large quantities of cargo, whereas speed and maneuverability is secondary. In the case of a powered sport vessel (e.g. air boat, cigarette boat, etc.) high speed stability is paramount. Recreational vessel design, on the other hand, (do to both cost constraints and the intended market for such "toys"), tends to compromise speed for safety; maneuverability for stability; and, fun for physical exertion.

More specifically, recreational vessels (both engine driven and manually powered) of the type generally available at resorts or beaches are of either one of two dominant varieties: the "Jet Ski" class of vessel or the manually powered boat (row boat, pedal boat or float tricycle). The popularity in the "Jet Ski" class of recreational vessel is by no small measure do the fact that manually powered boats are cumbersome, slow and relatively unmanuverable. Moreover, from the viewpoint of the concessionaires at resorts, beaches and mariners, manually power vessels have less customer appeal (as requiring considerable physical exertion and, thus, tend to be rented for a shorter period of time) and also can be maintenance intensive. The only and apparently saving grace for such manually powered recreational vessels is that their shortcomings also make them reasonably safe, particularly for small children or the inexperienced vacationer. Notwithstanding, such manually powered vessels are and continue to be dull and uninteresting and have declined in popularity.

Sail (wind) powered recreational vessels (e.g. catamarans and sail boards) have and continue to gain in popularity, however, require considerable skill to operate proficiently and require just the right amount of wind—too little breeze and they remain dead in the water and too strong a wind and they simply are not controllable; particularly in confined areas and in shallow waters which are frequented by swimmers. Thus, the vacationer or casual sailor has to tailor his sailing to the prevailing wind patterns, and must forego such activity if the conditions are unfavorable.

The following patents, discussed in chronological order (based upon their date of issue), are both typical and representative of the design concepts for manually powered recreational water craft:

U.S. Pat. No. 1,640,390 (issued Aug. 30, 1927) describes a surf board-like device having a pair of paddle wheels disposed laterally and mounted to common axle. The apparent configuration of Patentee's board contemplates synchronous rotation of each of the paddles wheels relative to one another; and further contemplates that both paddles wheels can be manually powered by rotational motion applied to either foot/hand pedal.

U.S. Pat. No. 3,714,921 (issued Feb. 6, 1973) describes a buoyant float wherein propulsion thereof is effected by a pair of paddles connected to the end of the float by a hinge-like mechanism. The float is propelled by the operator laying on the float and strapping the paddles to his ankles. The kicking action of the operator propels the float upon the water in the same manner as the kicking action of a swimmer outfitted with swim fins.

U.S. Pat. No. 3,874,319 (issued Apr. 1, 1975) describes a device which combines, in a single water craft, the features described U.S. Pat. Nos. 1,640,390 & 3,874,319. Patentee also purportedly further improves the stability and directional control of his craft by modification of the underside the float; the detail of which are unremarkable in the context of the instant invention.

U.S. Pat. No. 3,903,834 (issued Sep. 9, 1975) describes a hand driven water craft wherein the manual rotational of the hand pedals is translated via a spur gear train to power a drive shaft. A propeller at the end of the drive shaft is thereby caused to rotate and propels the craft through the water.

U.S. Pat. No. 4,867,716 (issued Sep. 19, 1989) describes a pontoon boat wherein each of the pontoons are contoured (or the outer surface thereof modified), to form an auger or screw. Upon transfer of pedal power from a gear train to the drive gear on each pontoon, the pontoon is rotated about its major (long) axis, thereby creating thrust which propels the craft thorough the water. In the embodiment of the invention illustrated by Patentee, each pontoon is powered by a different pedal drive and, thus, directional steering of the craft is accomplished, without the aid of a rudder, by unequal application of power to either pontoon; or, by counter rotation of one pontoon relative to the other.

U.S. Pat. No. 4,936,801 (issued Jun. 26, 1990) describes a flotation device wherein a frame is supported by a pair of outrigger-type floats and the topside of the frame adapted to mount a bicycle thereon, so as to mechanically couple (i) the rear wheel of the bicycle to a propulsion system for the floatation device, and (ii) the front wheel of the bicycle to a rudder so as to provide directional control for such floatation device (by simply turning the bicycle's front wheel).

U.S. Pat. No. 4,969,846 (issued Nov. 30 1990) describes a manually propelled boat wherein a single oar is mechanically coupled to a transmission which in turn is connected to a drive shaft mounted propeller. Upon reciprocal movement of the solitary oar, such manual power is converted, and coupled by, the transmission power to the drive shaft and shaft mounted propeller, thereby propelling the boat through the water.

As is, thus, evident from the foregoing discussion, and from review of the patents described above, there is and remains a continuing need to provide a safe, yet enjoyable, water craft that can be operated without undue exertion, risk of injury or need for instruction/experience, while at the same time satisfying the requirements of the concessionaire (low maintenance and doesn't exhaust the renter). The preferred water craft must also be capable of operation independent of wind conditions so as to free its operation from dependency upon the uncertainty in weather patterns and upon abrupt changes in such patterns, which can cause unsafe and ineffective operation of wind powered water craft. The preferred water craft of this invention is, thus, ideal for both private and commercial use in that its simplicity of design and construction makes it relatively inexpensive to own and maintain.

OBJECTS OF THE INVENTION

It is the object of this invention to remedy the above as well as related deficiencies in the prior art.

More specifically, it is the principle object of this invention to provide a recreational water craft of uncomplicated design and construction that can be manually powered by one or more individuals.

It is another object of this invention to provide a recreational water craft of uncomplicated design and construction that can be readily converted from manual power to sail without loss of stability or increase in complexity of operation.

It is yet another object of this invention to provide a manually powered recreational water craft of uncomplicated design and construction wherein manual power is supplied by one or more pair of paddle wheels, each member of such pair being independently mounted and driven and capable of tandem operation by more than one passenger or sailor.

It is yet another object of this invention to provide a manually powered recreational water craft of uncomplicated design and construction having a tri-hull design.

It is still yet another object of this invention to provide a manually powered recreational water craft of uncomplicated design and construction having a catamaran design.

Additional objects of this invention include the use of the above water craft as integral part of an exercise and physical fitness program wherein the adjustment of each of the hand grips on each of the paddle wheels is consciously selected to increase the physical exertion required for rotation of the paddle wheel.

SUMMARY OF THE INVENTION

The above and related objects are achieved by providing a water craft having the attributes of a tri-hull and/or catamaran vessel, wherein the crew is supported and operates such vessel from a centrally located platform or main float which is connected to, and flanked on either side by, an outrigger float or pontoon. In the design of the water craft of this invention, the lateral displacement of the outrigger floats relative the centrally located platform, creates an open well there between. Each outrigger float is further provided with a vertical extension or riser above the water line to which is mounted an independent and manually powered paddle wheel. The paddle wheels, upon mounting to the riser, are positioned in the open wells located to the port and starboard sides of the centrally located platform and inboard of each of the outrigger floats. Each of the paddle wheels each have a handle or hand grip on their inboard surface, which can be adjusted relative to the axis of rotation of each of such wheel, to accommodate the crew member's reach and his location on the main float, and thereby modulate the amount of force, and physical exertion, required to rotate the paddle wheel. The outboard surface of each paddle wheel is further provided with a plurality of vanes to provide forward or rearward thrust, upon rotation of the paddle wheels in one direction or the other, and thereby propel the craft through the water. Insofar as each of the paddle wheels is independently driven, the water craft's directional movement (steering) is determined by the relative amount of thrust created by rotation of either paddle wheel or by the counter-rotation of each such paddle wheel relative to one another.

In one of the preferred embodiments of this invention, the hull comprises an essentially unitary body wherein each of the main float and outrigger floats are formed and connected to one another, during manufacture (e.g. rotational casting). In another of the preferred embodiments of this invention, each of the risers on the outrigger floats is also adjustable to allow for re-positioning thereof either forward or aft on each such outrigger to accommodate the position of the crew, or more than one crew members and/or his passengers, on the main float.

DETAILED DESCRIPTION OF THE INVENTION INCLUDING PREFERRED EMBODIMENTS

Figure 1:
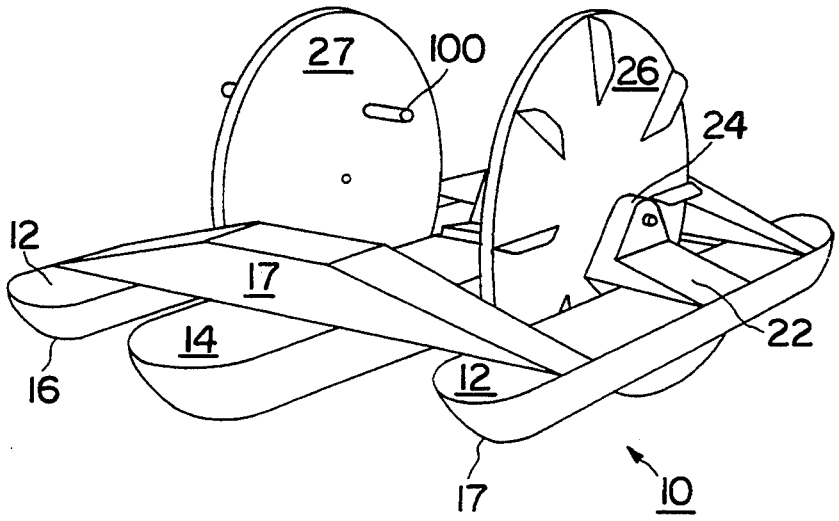
FIG. 1 is a perspective view of a preferred embodiment of the water craft of this invention.

The following description of the invention is made in reference to one or more of the above Figures. Where a component or structure is the same in more than one Figure, it is assigned a common reference numeral for ease of understanding and continuity of discussion.

As is readily appreciated by the water craft designer, the basic or traditional design of a water craft of "tri-hull" or "catamaran" design has come to have an art recognized meaning. The use of each such terms in the context of this invention is essentially same as such terms are used and recognized in the relevant art.

In one of the preferred embodiment of this invention, as shown in FIG. 1, the water craft (10) comprises a buoyant hollow body (12) of unitary construction. As illustrated in each of the Figures accompanying this illustration of the invention, such water craft is both simple and elegant by design. This preferred water craft comprises a centrally located platform (14) for support of one or more crew members and a pair of outrigger floats (16, 17) joined to the platform by a plurality of cross-members (18, 19, 20.21 ) on either end thereof. Each of these outriggers (16, 17) are further provided with a riser (22, 23) adapted for rotational mounting, on an inboard extension (24, 25) thereof, of a pair of paddle wheels (26, 27) within the open wells (28, 29) formed between the outrigger float and the centrally located platform. The placement and relative proportions of the foregoing structural components can, of course, vary with the designer's personal taste, the number of crew members the craft is contemplated to carry, the preferred hull design (tri-hull or catamaran) and the mode by which the craft is fabricated.

In the structure depicted in FIGS. 1 to 4, the water craft hull (12) has been designed for fabrication as a single unitary structure and its overall shape is believed to be compatible with cost efficient manufacture (e.g. rotational casting from relatively inexpensive polymeric materials). The basic configuration of the water craft hull (12) includes the three essentially three structural areas (14, 16, 17) described herein above, notwithstanding the absence of clearly defined separation there between. More specifically, the water craft depicted in the above Figures includes a centrally located platform (14) having a defined seating area (15). As is further apparent, this seating area (15) includes both a seat back and foot rest. Each of the outrigger floats (16, 17) are integral with and form an essentially continuos perimeter or frame upon their attachment at their respective ends to the forward and aft ends of the seating platform. This geometry provides not only structural integrity to the craft but also protects the crew members from potential injury in the unlikely event of collision of the water craft with another vessel. Moreover, as will be apparent from the design and operation of the paddle wheels described hereinafter, the mounting of the paddle wheels inboard of the pontoon floats (and the relative location of the vanes positioned thereon) is consciously undertaken to isolate the churning action of such wheels form both crew members and the occasional swimmer that may come in contact wiht the craft.

Figure 2:
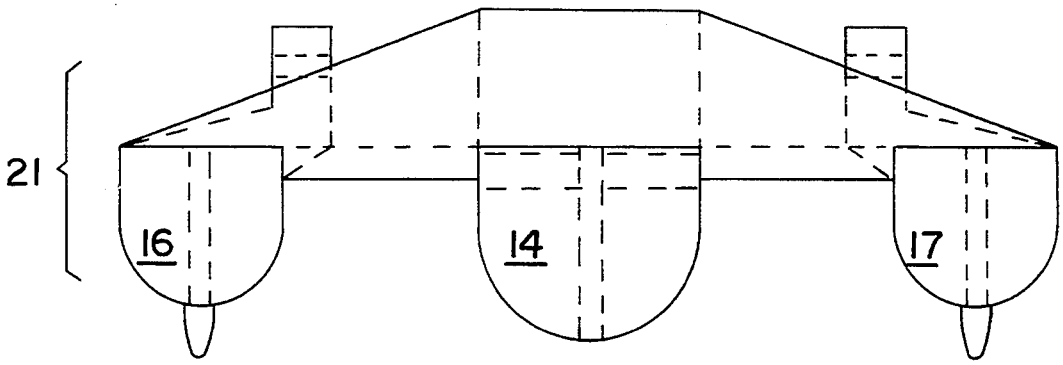
FIG. 2 is an end view of the water craft of FIG. 1 when viewed from the front.
Figure 3:
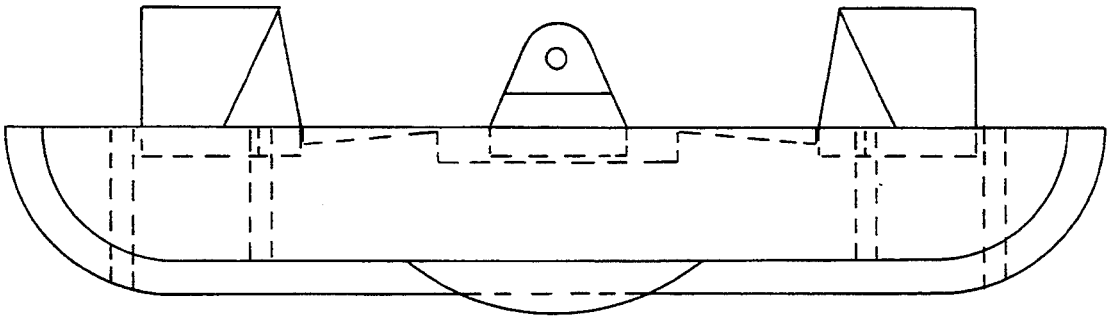
FIG. 3 is a side view of the water craft of FIG. 1.
Figure 4:
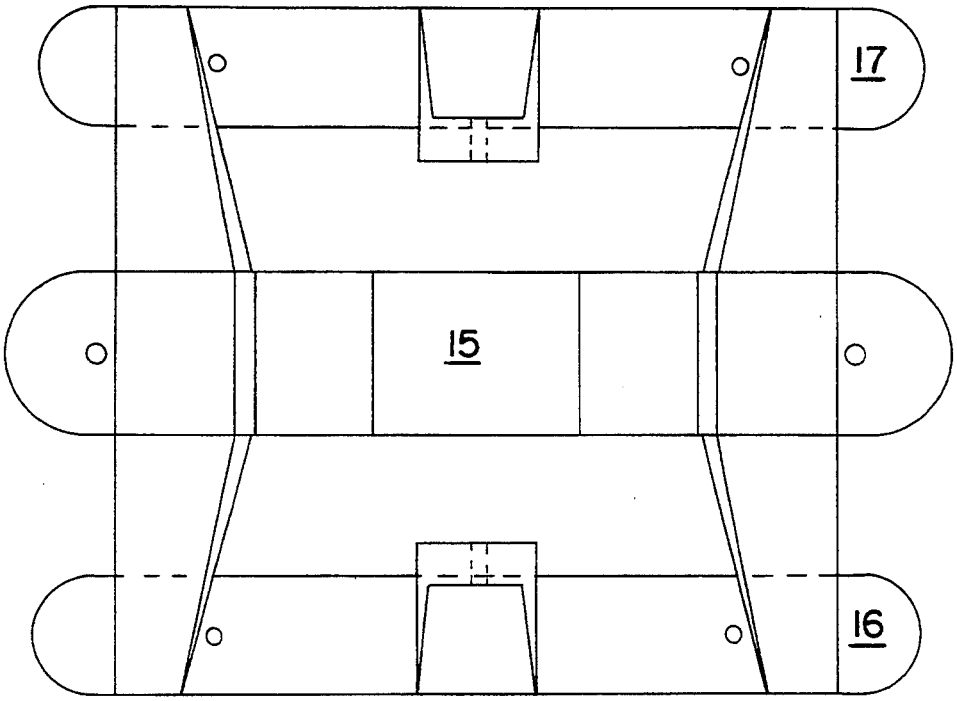
FIG. 4 is a top view of the water craft of FIG. 1.

Each of the paddle wheels have been deleted from the illustrations of the invention provided in FIGS. 2 to 4 in order to better illustrate both the relative location of the risers on each of the outrigger floats, the inboard extension at the top end thereof and the height of the riser in relation to overall length of the water craft. At the outset it is noted and emphasized that the illustration of this invention provided in the foregoing Figures is intended for one, or possibly two, crew members. Accordingly, the overall geometry of the craft presents a symmetrical appearance which is not essential to either its operation or to the preferred distribution of crew and passengers. Notwithstanding, the height of the riser is chosen to accommodate a paddle wheel of sufficient diameter to permit relative exertion free propulsion of the water craft and yet sufficient speed and maneuverability to provide an attractive and enjoyable boating experience.

Figure 5A:
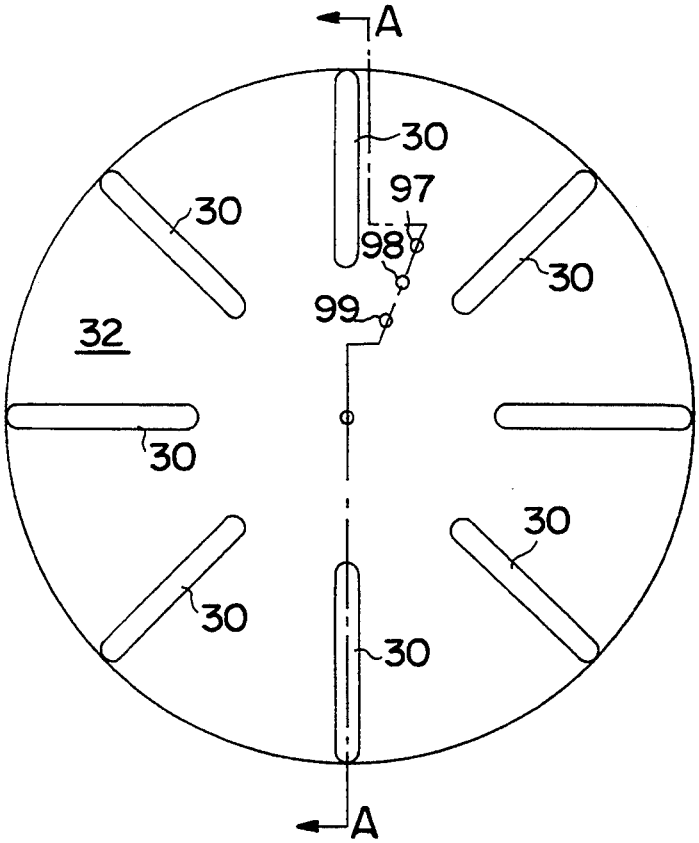
FIG. 5*a* is an enlarged view of a paddle wheel of the water craft. shown in FIG. 1.

In the embodiment of the invention shown in the foregoing FIGS. 1 and 5*a*, the paddle wheels (26, 27) are approximately 42 inches in diameter, are typically equipped with 8 to 10 vanes (30) on the outboard surface (32) thereof, (each of the individual vanes being 6 to 8 inches in overall length) and have a centrally located hub. The design of the paddle wheels of watercraft, and the manner in which they mount to the risers, positions the vanes to avoid any contact and potential injury to crew and passengers with such vanes; and, further minimizes water spray from such rotating wheels, by placement of the vanes on the outboard surface of the paddle wheels. The size (diameter) and the relative position of the wheel hub to bearing mount on the riser is engineered so as the wheel extends below the water line approximately 8 to 10 inches and thereby provides for essentially complete immersion of the vane in the water during rotation of the wheel and a smooth and continuos power stroke (e.g. at least two of the vanes of the paddle wheel are preferably at least partially immersed below the water line during rotation of the wheel).

Figure 5B:
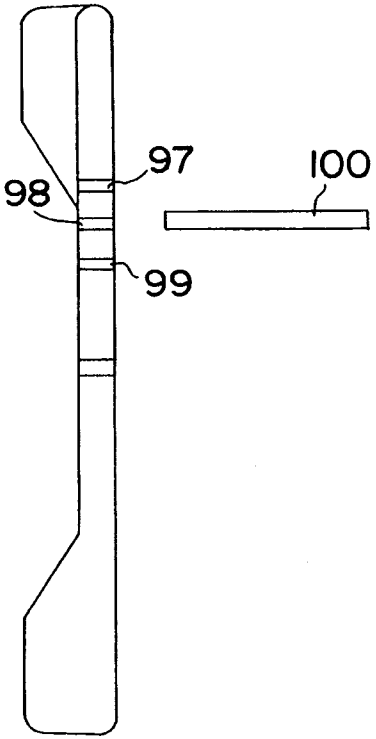
FIG. 5*b* is a cross-sectional view of the paddle wheel of FIG. 5*a* at AA.

The inboard surface 33 of each paddle wheel, as revealed in cross section in FIG. 5*b*, includes a series (97, 98, 99) of holes or equivalent means for attachment of a handle or hand grip to the inboard surface of the paddle wheel at a manually adjustable location selected by the crew member. Preferably, the location of the hand grip on the paddle wheel will be infinitely adjustable on the inboard surface within a defined range on such inboard surface.

As is evident from the foregoing design, the craft has a low center of gravity thus making it highly stable in choppy water; and can be maneuvered in confined and congested areas, including the having the ability to rotate (complete 360 degree turn) about its vertical axis (defined as the vertical line that intersects the mid-point between an imaginary line connecting the hubs of each paddle wheel).

Figure 6:
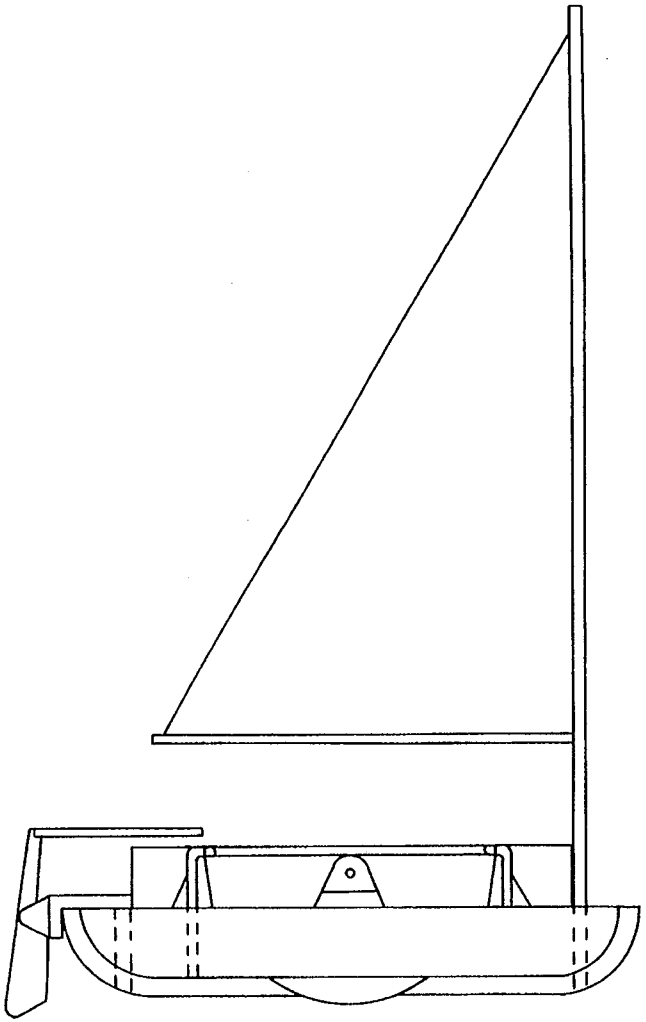
FIG. 6 is a side view of the water craft of FIG. 1 that has been converted to sail power.

FIG. 6 illustrates the adaptation of the hull of the water craft of FIG. 1 to a sail craft resembling a mini-catamaran. In the craft depicted in FIG. 6 the paddle wheels have been removed from the risers and the power supplied by a sail wherein the mast thereof has been mounted on the bow of the hull of the water craft. The hull of the water craft of FIG. 1 has been further modified in FIG. 6 by addition of a flexible (e.g. canvas) deck supported on a rectangular frame and a series of frame legs fitted to the outrigger floats. The stem of the water craft of FIG. 1 is further modified in FIG. 6 by the addition of a rudder assembly to provide directional steering of the craft. In the preferred embodiments of this invention, each of the outrigger floats are further provided with a centerboard (34, 35), or its equivalent, mounted below the water line on each such outrigger to enhance the stability of the water craft when under sail.

In an alternative to the configurations illustrated in FIGS. 1 and 6, the water craft of FIG. 1 can be modified by the addition of a mast and sail. The novel and highly adaptive design of the water craft of this invention can be further customized to include additional creature comforts (e.g. sun canopy, trawling motor mount assembly and motor) and competition oriented accessories to reduce wind resistance and increase speed, without departing from the spirit or scope of the invention.

The proportions and relative position of one or more of the components of the watercraft of this invention may vary with construction techniques, materials preferences and engineering specifications for this craft. For example, the addition of reinforcement, as by the use of foam, ribs or stringers, to add strength and reduce weight can permit streamlining of this craft without departure from the spirti and scope of this invention.

What is claimed is:

1. In a recreational water craft having means for manual propulsion thereof by means of a paddle wheel wherein the improvement comprises:

a. a platform for support of one or more passengers; and b. means for attachment of said platform to a pair of outrigger floats positioned on the port and starboard side of said platform, whereby a well is defined between each of said outrigger floats and the platform, each of said outrigger floats being characterized as having a vertical extension or riser, each of said riser having means for rotational mounting of a paddle wheel thereto so as to position said paddle wheel pair within one of the wells formed between each of said outrigger floats and said platform; and c. a pair of paddle wheels, each said paddle wheel having an inboard surface and an outboard surface, the inboard surface thereof having means for directly imparting manual rotational movement of said wheel and the outboard surface thereof having a plurality of vanes for translation of the rotational movement of said wheel to thrust, said inboard surface being further characterized as having means for adjustment of the relative position of said rotational movement means on said inboard surface thereof so as position said rotational movement means within arm's length reach of a passenger for effective hand rotation of said paddle wheel.

2. The improvement of claim 1, wherein said platform comprises a float and is further characterized as having seating means for one or more passengers.

3. The improvement of claim 2, wherein the water craft comprises a tri-hull structural configuration.

4. The improvement of claim 1, wherein the water craft is of unitary construction, in that each of the platform, attachment means and outrigger floats are formed as a single structure within a common mold at the same time.

5. The improvement of claim 1, wherein the water craft comprises a catamaran structural configuration wherein each of the outrigger floats are rigidly connected to one another by said attachment means; and, the platform comprises an essentially flat deck.

6. The improvement of claim 5, wherein the water craft is further provided with means for attachment of a mast and sail.

7. The improvement of claim 1, wherein each of said outrigger floats is further provided with a centerboard on the underside thereof so as to enhance the stability of the water craft.

* * * * *